US011099594B1

(12) United States Patent
Kanoun

(10) Patent No.: US 11,099,594 B1
(45) Date of Patent: Aug. 24, 2021

(54) BANDGAP REFERENCE CIRCUIT

(71) Applicant: SEMICONDUCTOR COMPONENTS INDUSTRIES, LLC, Phoenix, AZ (US)

(72) Inventor: Moez Kanoun, Waterloo (CA)

(73) Assignee: SEMICONDUCTOR COMPONENTS INDUSTRIES, LLC, Phoenix, AZ (US)

( * ) Notice: Subject to any disclaimer, the term of this patent is extended or adjusted under 35 U.S.C. 154(b) by 0 days.

(21) Appl. No.: 16/948,415

(22) Filed: Sep. 17, 2020

Related U.S. Application Data

(60) Provisional application No. 62/979,468, filed on Feb. 21, 2020.

(51) Int. Cl.
*G05F 3/30* (2006.01)
*G05F 3/26* (2006.01)

(52) U.S. Cl.
CPC ..... *G05F 3/30* (2013.01); *G05F 3/267* (2013.01)

(58) Field of Classification Search
None
See application file for complete search history.

(56) References Cited

U.S. PATENT DOCUMENTS 6,897,717 B1 * 5/2005 Eddleman ..... G05F 3/262 327/108
7,323,857 B2 * 1/2008 Sung ..... G05F 3/30 323/316
7,570,107 B2 * 8/2009 Kim ..... G05F 3/30 323/313
7,750,728 B2 * 7/2010 Marinca ..... G05F 3/30 327/539
9,459,647 B2 * 10/2016 Hu ..... G05F 3/30
2002/0093325 A1 7/2002 Ju
2007/0075699 A1 4/2007 Chih

OTHER PUBLICATIONS

Ueno et al., "A 1-UW 600-PPM/C Current Reference Circuit Consisting of Subthreshold CMOS Circuits"; IEEE Transactions on Circuits and Systems—II: Express Briefs, vol. 57, No. 9; Sep. 2010; 6 pages.
Kin Keung Lee et al., "A sub-u W Bandgap Reference Circuit With an Inherent Curvature-Compensation Property", IEEE Transactions on Circuits and Systems—I: Regular Papers, vol. 62, No. 1, Jan. 2015.

* cited by examiner

*Primary Examiner* — Jeffery S Zweizig
(74) *Attorney, Agent, or Firm* — Brake Hughes Bellermann LLP

(57) ABSTRACT

The disclosed bandgap circuit is configured to provide a temperature stable reference current and/or voltage that is also adjustable. The stability can be facilitated by an improved matching of current mirrors provided by a source degeneration topology. The source degeneration can reduce random mismatches without requiring increased size or complexity of the current mirrors and can facilitate operation of the current mirrors in a weak inversion condition, in which random mismatches may be most severe. Further, the source degeneration may be adjusted to adjust a level and/or a temperature coefficient of the generated reference current and/or voltage.

19 Claims, 6 Drawing Sheets

BANDGAP REFERENCE CIRCUIT

CROSS-REFERENCE TO RELATED APPLICATION

This application claims the benefit of U.S. Provisional Patent Application No. 62/979,468, filed on Feb. 21, 2020, which is incorporated by reference in its entirety.

FIELD OF THE DISCLOSURE

The present disclosure relates to microelectronic circuits and more specifically to a bandgap reference circuit for generating a temperature independent voltage or current.

BACKGROUND

A bandgap reference circuit is a functional block of an integrated circuit/system that can generate a voltage and/or current that does not change significantly with temperature. In other words, a bandgap reference can have a temperature coefficient (TC) that is relatively flat over a range of temperatures (e.g., 0-60 degrees C.). The relatively flat temperature coefficient may be generated by summing a current source that is proportional to absolute temperature with a current source that is complementary to absolute temperature. In other words, the temperature dependence of the proportional and complementary current sources may cancel to produce a reference current that is relatively insensitive to temperature. The current source that is proportional to absolute temperature and the current source that is complementary to absolute temperature may also be used to generate a reference voltage that is relatively insensitive to temperature.

SUMMARY

In at least one aspect, the present disclosure generally describes a method for generating a reference current. The method includes generating a proportional-to-absolute-temperature (i.e., PTAT) current and generating a complementary-to-absolute-temperature (i.e., CTAT) current. The method further includes generating a first copy of the PTAT current using a PTAT current mirror with source degeneration and generating a first copy of the CTAT current using a CTAT current mirror with source degeneration. The method further includes summing the first copy of the PTAT current and the first copy of the CTAT current to obtain a first reference current with a first temperature coefficient.

In a possible implementation, the method further includes adjusting the source generation of the PTAT current mirror and/or the CTAT current mirror to obtain a second reference current with a second temperature coefficient.

In another possible implementation, the method further includes using the first reference current to generate a first reference voltage. For example, the method may include inputting the first reference current to a first output resistor to obtain a first reference voltage.

In another aspect, the present disclosure generally describes a bandgap reference circuit. The bandgap reference circuit includes a current generator that is configured to generate a PTAT current and a CTAT current. The bandgap reference circuit further includes a PTAT current mirror with source degeneration. The PTAT current mirror with source degeneration is coupled to the current generator and is configured to generate at least one copy of the PTAT current. The CTAT current mirror with source degeneration is coupled to the current generator and is configured to generate at least one copy of the CTAT current. The bandgap reference circuit further includes at least one output. Each of the at least one output is configured to combine one of the at least one copy of the PTAT current with one of the at least one copy of the CTAT current to generate a reference current.

In another aspect, the present disclosure generally describes a bandgap reference circuit. The bandgap reference circuit includes a current generator that is configured to generate a PTAT current and a CTAT current. The bandgap reference circuit further includes a PTAT current mirror with source degeneration. The PTAT current mirror with source degeneration is coupled to the current generator and is configured to generate at least one copy of the PTAT current. The CTAT current mirror with source degeneration is coupled to the current generator and is configured to generate at least one copy of the CTAT current. The PTAT current mirror and the CTAT current mirror are each in a cascode configuration. The bandgap reference circuit further includes at least one output. Each of the at least one output is configured to combine one of the at least one copy of the PTAT current with one of the at least one copy of the CTAT current to generate a reference current.

The foregoing illustrative summary, as well as other exemplary objectives and/or advantages of the disclosure, and the manner in which the same are accomplished, are further explained within the following detailed description and its accompanying drawings.

BRIEF DESCRIPTION OF THE DRAWINGS

The components in the drawings are not necessarily to scale relative to each other. Like reference numerals designate corresponding parts throughout the several views.

DETAILED DESCRIPTION

Figure 1:
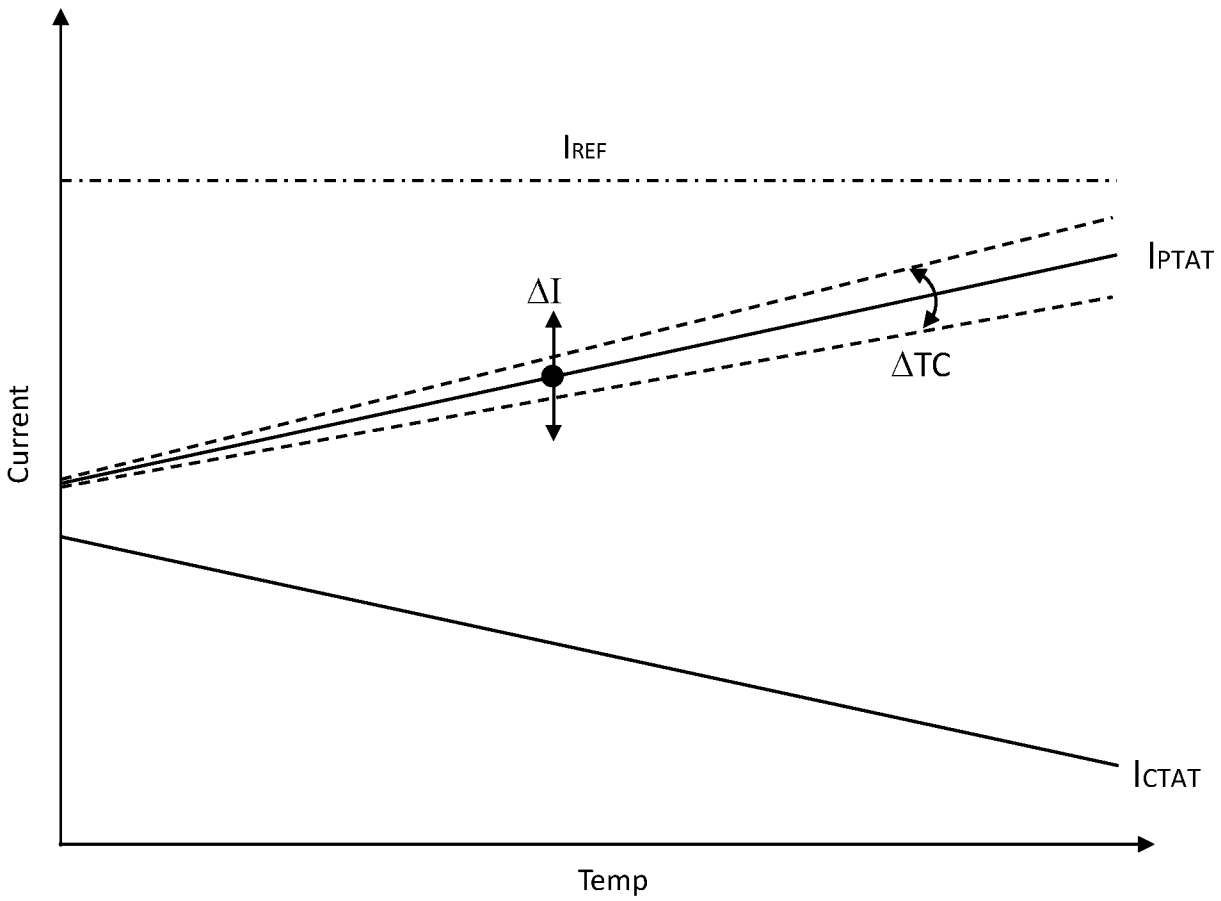
FIG. 1 is a graph illustrating a PTAT current and a CTAT current versus temperature for a bandgap reference circuit according to a possible implementation of the present disclosure.

In a bandgap reference circuit, the PTAT and the CTAT current sources may require one or more current mirrors for operation. Each current mirror may include a pair of transistors that are ideally matched. A mismatch between the pair of transistors in a current mirror can create an error in a PTAT current and/or a CTAT current at a particular temperature. A mismatch between the pair of transistors in the current mirror can also change the way the PTAT current and/or the CTAT current respond to a change in temperature (i.e., a PTAT/CTAT temperature coefficient).

The mismatch may be a random mismatch resulting from variations in a fabrication process for the transistors. The variations can result in properties (e.g., channel dimensions, doping, etc.) of the transistors that vary randomly. The random variations may be reduced (i.e., the matching may be improved) by averaging the variations over an area of a large transistor or over a plurality of small transistors that (after trimming) act together as a larger transistor. In either case, this approach can require an increase in a die area for the bandgap reference, which may not be desirable in some applications (e.g., mobile applications). Additionally, some applications (e.g., low power applications) may operate the transistors in a weak inversion (i.e., subthreshold) condition, and the effects of the random mismatch described thus far may become more pronounced in the weak inversion condition.

The present disclosure describes a bandgap reference circuit and a method for generating a reference current/voltage. The use of a source degeneration topology provides a variety of advantages to the bandgap reference circuit. For example, the source degeneration avoids the need to use a large sized transistor or a combination of multiple transistors to compensate for a random mismatch, thereby reducing a die area (i.e., size) of the bandgap reference circuit. The source degeneration facilitates a convenient tuning of the PTAT current and/or the CTAT current, which can be used to reduce a temperature coefficient of the reference current/voltage. Further, the source degeneration is compatible with low power operation.

The disclosed circuits and methods may be implemented to reduce a temperature variation of a reference voltage/current generated by the bandgap reference circuit. The temperature variation can result from a random mismatch due to variable fabrication process parameters. In some implementations (e.g., cascode implementations), the disclosed circuits and methods can further reduce a temperature variation resulting from a systematic mismatch related to aspects (e.g., output impedance) of the circuit design and/or layout. In either case, the disclosed circuits and methods may reduce the temperature variation of a generated reference current or reference voltage over a temperature range and can provide a convenient means for adjusting a particular current or a variation of the current over temperature (i.e., temperature coefficient). In other words, the disclosed circuits and methods can be configured to provide a temperature coefficient (i.e., temperature dependency) of the bandgap reference circuit that is flat over a range of temperatures (e.g., 0-100 degrees Celsius). The temperature dependency of the disclosed circuits and methods may be very flat as measured in parts-per-million per degree Celsius (PPM/° C.). For example, the temperature dependency of a reference voltage may be less than 50 PPM/° C. and the temperature dependency of a reference current may be less than 750 PPM/° C. for a range of temperatures (e.g., 0° C. to 100° C.).

A bandgap reference circuit is configured to generate a voltage/current that is ideally stable with temperature. To accomplish this temperature stability, the bandgap circuit is configured to generate a reference voltage/current (i.e., reference voltage and/or reference current) based on a PTAT current and a CTAT current.

FIG. 1 illustrates a PTAT current and a CTAT current as a function of temperature. As shown, the PTAT current ($I_{PTAT}$) increases in proportion to a temperature increase (i.e., has a positive temperature coefficient), while the CTAT current ($I_{CTAT}$) decreases in proportion to a temperature increase (i.e., has a negative temperature coefficient). When the PTAT current and the CTAT current are combined (i.e., summed) the resulting reference current ($I_{REF}$) has a PTAT portion with a positive temperature coefficient and a CTAT portion with a negative temperature coefficient. When the positive portion and the negative portion are balanced, the combined current ($I_{REF}$) is stable (i.e., does not change) with temperature. While not shown in FIG. 1, the PTAT current and the CTAT current can be used to generate (e.g., using a resistor) a reference voltage ($V_{REF}$) that is stable with temperature.

Figure 2:
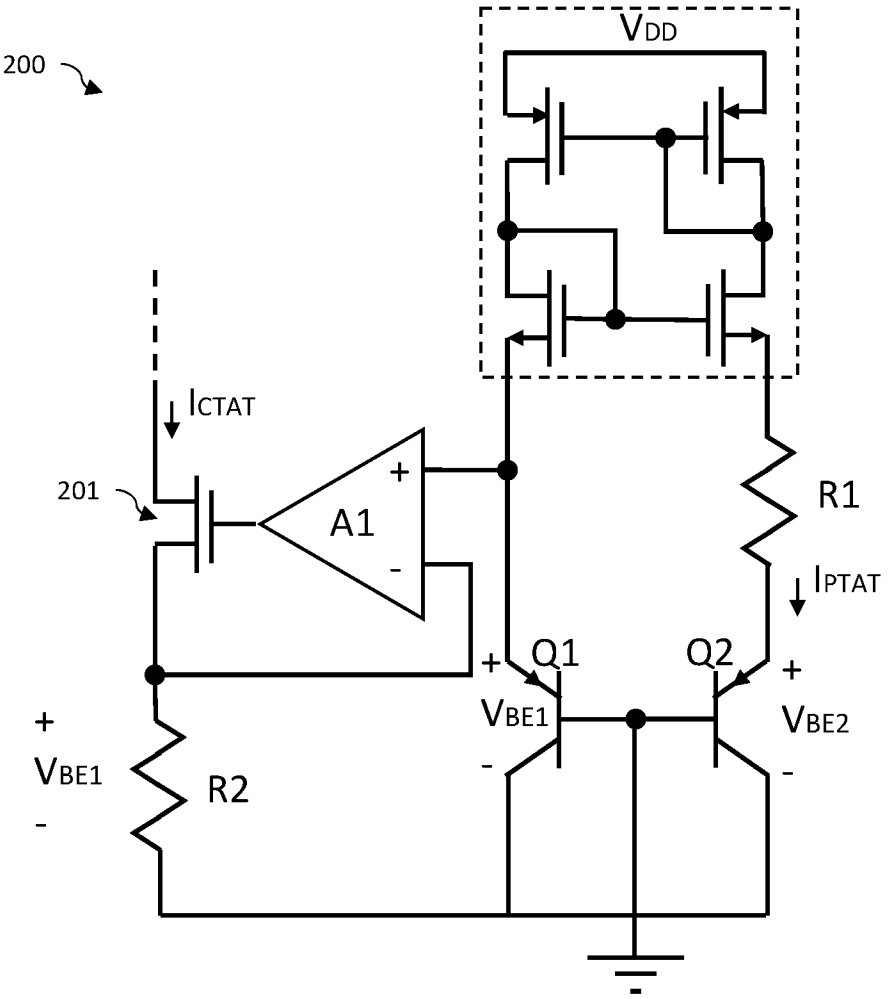
FIG. 2 is a schematic block diagram of a PTAT and CTAT current generator portion of a bandgap reference circuit according to a possible implementation of the present disclosure.

FIG. 2 is a schematic block diagram of a portion of a bandgap reference circuit configured to generate the PTAT current ($I_{PTAT}$) and the CTAT current ($I_{CTAT}$). In other words, FIG. 2 illustrates a PTAT and CTAT current generator. The circuit 200 includes a first diode-connected transistor (Q1) and a second diode-connected transistor (Q2). The transistors can be P-type transistors (e.g., bipolar junction transistors, BJTs), each having a p-n junction between an emitter of the transistor and a (ground coupled) base of the transistor. The PTAT current ($I_{PTAT}$) can be generated from the voltage difference between the p-n junctions (i.e., voltage difference between the base-emitter voltages, $\Delta V_{BE}$). For example, as shown in FIG. 2, the PTAT current flows through a first resistor ($R_1$) and is given by the equation below.

$$I_{PTAT}=(V_{BE1}-V_{BE2})/R_1=\Delta V_{BE}/R_1 \quad (1)$$

The circuit 200 includes a feedback amplifier (A1) coupled to a transistor 201 to induce a current through the second resistor (R2) that is related to the base-emitter voltage of the first transistor (Q1). Because the p-n junction of the diode-connected transistor exhibits a negative temperature coefficient the CTAT current is given by the equation below.

$$I_{CTAT}=V_{BE1}/R_2 \quad (2)$$

A bandgap reference current ($I_{REF}$) can be created as the sum of a PTAT current component ($I_{PTAT}$) and a CTAT current component ($I_{CTAT}$), as shown in the equation below.

$$I_{REF}=I_{PTAT}+I_{CTAT} \quad (3)$$

Similarly, a bandgap reference voltage ($V_{REF}$) can be created as the sum of a PTAT voltage component ($V_{PTAT}$) and a CTAT voltage component ($V_{CTAT}$) (e.g., $V_{REF}=V_{PTAT}+V_{CTAT}$).

In practice, the PTAT current component and the CTAT current component may be adjusted to a desired reference current level and/or a desired temperature coefficient (TC) of the reference current.

Errors in either the PTAT current component ($I_{PTAT}$) or the CTAT current component ($I_{CTAT}$) can result in a reference current ($I_{REF}$) with an undesired level at a particular temperature or that varies (e.g., more than expected) with temperature. As shown in FIG. 1 errors can be a deviation ($\Delta I$) in a value of a current at a particular temperature or can be a deviation ($\Delta TC$) in a rate that the current changes with temperature. These errors may be generated when a pair of transistors in a current mirror are not matched precisely. Accordingly, variations in the temperature coefficient can result from imperfect mirroring of the PTAT and CTAT currents in the bandgap reference circuit.

A current mirror relies on a matched pair of transistors for accurate mirroring (i.e., copying) of a current from a first transistor of the current mirror to a second transistor of the current mirror. Accordingly, it may be desirable to reduce mismatches to improve a performance of the current mirror. Further, the matching performance of the current for the pair of transistors depends on the operating region (i.e., mode) of the pair of transistors. When the pair of transistors are operated in a sub-threshold (i.e., weak inversion) region, the matching of the pair of transistors may be worse than when operated in strong inversion. In other words, the matching performance may be the worst in the weak inversion region. Accordingly, it may be further desirable to mitigate a reduction in a matching performance due to weak inversion operation.

Figure 3:
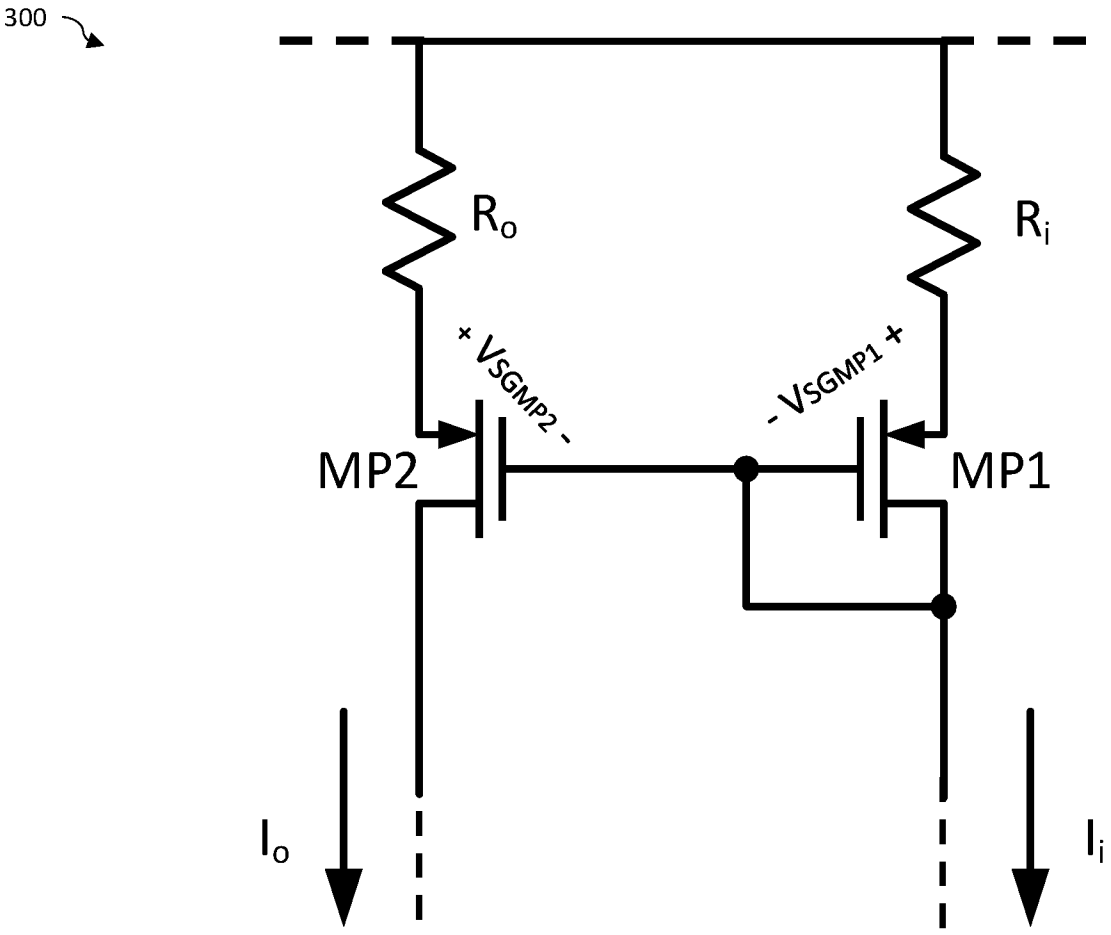
FIG. 3 is a schematic of a current mirror with source degeneration portion of a bandgap reference circuit according to an implementation of the present disclosure.

FIG. 3 is a schematic of a current mirror portion of a possible bandgap reference circuit. The current mirror 300 includes an input resistor (Ri) coupled to a source terminal of a first (p-type) metal oxide semiconductor (i.e., MOS) transistor (MP1) and an output resistor (Ro) coupled to a source terminal of a second (p-type) MOS transistor (MP2). When the input resistor (Ri) and the output resistor (Ro) are non-zero, the current mirror is said to have source degeneration (i.e., is source degenerated). In other words, a current mirror in a source degeneration topology includes resistors (Ri, Ro) on the source terminals of the transistors of the current mirror.

As stated previously, the matching performance of a current mirror can be highly dependent on its region of operation. For a current mirror without source degeneration (i.e., for a current mirror in which the input resistor (Ri) and the output resistor (Ro) are zero), the relative source-drain current error for a MOS transistor in the current mirror is given by the equations below.

$$\left(\frac{\sigma(\Delta I)}{I}\right)^2 = \left(\frac{\sigma(\Delta\beta)}{\beta}\right)^2 + \left(\frac{g_m}{I}\right)^2 \sigma^2(\Delta V_{TH}) \tag{4}$$

$$\sigma^2(\Delta V_{TH}) = \frac{A_{V_{TH}}^2}{WL} \tag{5}$$

$$\left(\frac{\sigma(\Delta\beta)}{\beta}\right)^2 = \frac{A_\beta^2}{WL} \tag{6}$$

In the above equation, W and L are respectively the gate-width and the gate-length of the transistor, $A_{V_{TH}}$ and $A_\beta$ the proportionality constants which are technology-dependent, $\beta=\mu C_{OX}W/L$, $\mu$ the carrier mobility, $C_{OX}$ the gate-oxide capacitance per unit area.

The transconductance-to-current ratio ($g_m/I$) is the only parameter in equation (4) that is bias dependent while $\sigma(\Delta V_{TH})$ and $$\frac{\sigma(\Delta\beta)}{\beta}$$

depend on the technology and the transistor area (e.g., WL). The transconductance-to-current ratio is strongly related to the transistor operation. The transconductance-to-current ratio is high (e.g., maximum) value when the MOS transistor is in a weak inversion region, is lower when the MOS transistor is operated in a moderate inversion region and is still lower when the MOS transistor is operated in a strong inversion region.

For the current mirror without source degeneration (i.e., Ro=Ri=0) operating in the weak inversion region, the transconductance-to current ratio of the transistor can be expressed by the equations below.

$$g_m = \frac{I}{\eta V_T} \tag{7}$$

$$V_T = k_B T/q \tag{8}$$

In the equations above, $k_B$ is the Boltzmann constant, T is the absolute temperature, q is the elementary charge and $\eta$ is a subthreshold slope factor. Thus, for the current mirror without source degeneration (i.e., Ro=Ri=0), the relative source-drain current error can be high. For example, at room temperature (T=300 Kelvin (K)), $V_T \approx 26$ millivolts (mV), and a subthreshold slope factor of about 1.5 (i.e., $\eta \approx 1.5$), the transconductance-to-current ratio is about 25.6 per volt ($V^{-1}$), which can induce a significant relative source-drain current error.

To decrease the source-drain current error, the area (e.g., WL) of the transistor can be increased and the transconductance-to-current ratio can be reduced. The transconductance-to-current ratio can be reduced by decreasing the W/L ratio of the transistor to move the operating point from weak inversion towards strong inversion while keeping a large transistor area. Simply increasing the size of a transistor, however, can require more physical (die) area. Instead of these approaches, the disclosed current mirror is configured to decrease the transconductance-to-current ratio (and thus the relative source-drain current error) using source degeneration (i.e., Ro>0, Ri>0).

When the input and output resistors are non-zero, the effective transconductance, $G_M$, can be expressed by the equation below.

$$G_m = \frac{g_m}{1 + g_m R_o} \tag{9}$$

If $Ro \gg 1/g_m$, then $G_m$ is approximately 1/Ro. Using this approximation, the transconductance-to-current ratio can be given by the equation below.

$$\frac{G_m}{I_o} = \frac{1}{R_o I_o} \tag{10}$$

Thus, for a current mirror with source degeneration (i.e., Ro>0, Ri>0) the relative source-drain current error can be lower (than for the current mirror without source degeneration). For example, if RoIo is approximately 150 mV, then the transconductance-to-current ratio is about 6.6 $V^{-1}$, which is significantly lower compared to the value derived above for the simple current mirror in weak inversion (i.e., $g_m/I \approx 25.6V^{-1}$).

The disclosed bandgap reference circuit uses a source degeneration current mirror topology to significantly improve the matching performance and hence lower a variation of the temperature coefficient of the mirrored PTAT and CTAT currents.

Beside the matching performance, source degeneration offers the possibility to tune the temperature coefficient of the mirrored PTAT or CTAT currents. For example, in the current mirror of FIG. 3, the voltages in the input portion are equal to the voltages in the output portion and, thus using circuit analysis, the relationship between the output current and the input current can be expressed by the equation below.

$$R_o I_o + V_{SG_{MP2}} = R_i I_i + V_{SG_{MP1}} \tag{11}$$

The drain current of a MOS transistor operating in weak invention can be expressed by the equation below.

$$I_d = \mu_p C_{OX} V_T^2 \frac{W}{L} \exp\left(\frac{V_{SG} - V_{TH}}{nV_T}\right) \tag{12}$$

Equations (11) and (12) can be combined as the equation below.

$$R_o I_o = R_i I_i - nV_T ln\left(\frac{I_o}{I_i}\right) + V_{TH1} - V_{TH2} \tag{13}$$

Assuming that the transistors are perfectly matched (i.e., $\Delta V_{SB}=0$, MP1=MP2) implies $V_{TH1}=V_{TH2}$. Therefore, equation (13) can be modified as the equation below.

$$R_o I_o = R_i I_i = -nV_T ln\left(\frac{I_o}{I_i}\right) \tag{14}$$

By differentiating equation (14) by temperature and assuming that the input current (Ii) does not vary with temperature yields the equation below.

$$\frac{\partial R_t}{\partial T} I_i - \frac{\partial R_o}{\partial T} I_O - n\frac{\partial V_T}{\partial T}\log\left(\frac{I_o}{I_i}\right) = \left(R_o + nV_T\frac{1}{I_o}\right)\frac{\partial I_o}{\partial T} \tag{15}$$

In this equation the resistor Ro can be expressed by the equation below.

$$R=R_{T_i}[1+\alpha(T_i-T)] \tag{16}$$

In the equation above α is the resistance relative temperature coefficient, having the units of percent per degree (%/C). Using equation (13), equation (15), and equation (16), it can be shown that the output current under these assumptions has a temperature coefficient given by the equation below.

$$\frac{\partial I_o}{\partial T} = \frac{nI_o\left(\alpha V_T + \frac{\partial V_T}{\partial T}\right)}{R_o I_o + nV_T}\ln\left(\frac{I_i}{I_o}\right) \tag{17}$$

From equation (14) and equation (17) it can be shown that the temperature coefficient of Io is related to the ratio Ii/Io, which in turn, is related to the ratio Ri/Ro. Accordingly, the temperature coefficient of Io (i.e., TC) can be adjusted by adjusting the ratio of Ri/Ro. The adjustment of the temperature coefficient may be substantially linear (e.g., linear) with the adjustment of the ratio Ri/Ro provided that the adjustment to the ratio Ri/Ro is small (e.g., about ±20%). The temperature coefficient of Io can be positive or negative based on the ratio Ri/Ro. In other words, an adjustment to the source degeneration resistors can control a level or a temperature coefficient of the reference current.

Figure 4:
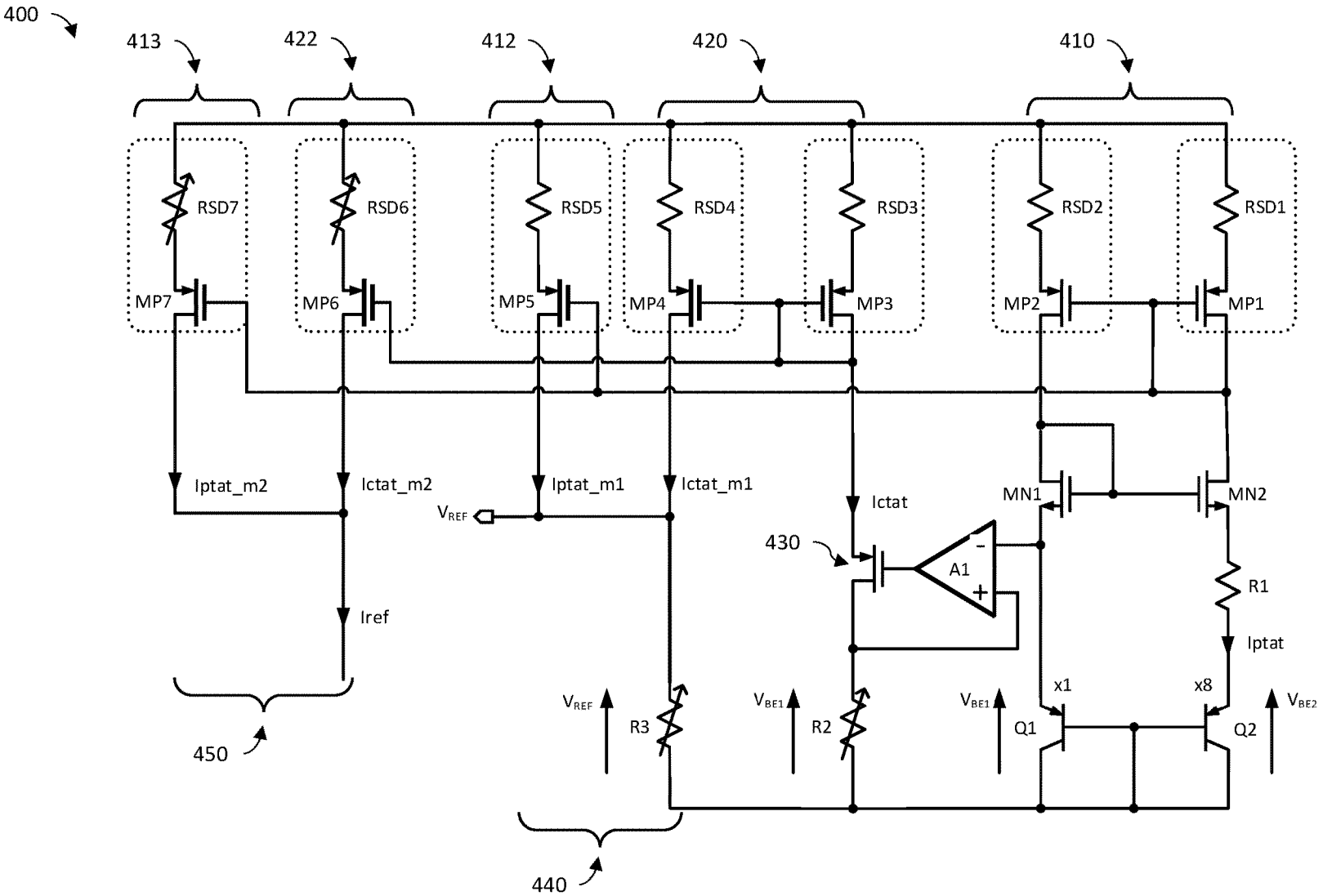
FIG. 4 is a schematic of a bandgap reference circuit according to a first possible implementation of the present disclosure.

FIG. 4 is a schematic of a bandgap reference circuit according to a first possible implementation of the present disclosure. The bandgap reference circuit 400 includes a first current mirror (i.e., PTAT current mirror 410) in a source degeneration topology (i.e., configuration) that includes a PTAT current mirror input transistor, MP1, and a (first) PTAT current mirror output transistor, MP2. Additionally, the first current mirror includes source degeneration resistors RSD1 and RSD2. The first source degeneration resistor (RSD1) can be coupled between an upper rail voltage and a source terminal of a first (i.e., input) p-type MOS transistor (MP1) of the PTAT current mirror 410. The second source degeneration resistor (RSD2) can be coupled between the upper rail voltage and a source terminal of a second (i.e., first output) p-type MOS transistor (MP2) of the PTAT current mirror 410. The PTAT current mirror 410 is configured to generate matching currents to bias transistors MN1 and MN2. Accordingly, a gate-source voltage ($V_{GS}$) of MN1 can substantially match (e.g., equal) a gate-source voltage of MN2.

The bandgap reference circuit 400 circuit further includes a first diode-connected transistor (Q1) and a second diode-connected transistor (Q2) that each have base terminals and collector terminals coupled together (e.g., forming a ground for the circuit). Current from MN1 can generate a first base-emitter voltage $V_{BE1}$ across Q1 and the (matching) current from MN2 can generate a second base-emitter voltage, $V_{BE2}$, across Q2. Q1 and Q2 may be sized differently. For example, Q2 may be 8 times the size of Q1. In this situation, the base-emitter voltage across each transistor may be different, and the PTAT current ($I_{PTAT}$) may be given as the difference in the base-emitter voltages ($\Delta V_{BE}$) divided by a first resistor (R1) (e.g., see equation (1)).

The first base-emitter voltage ($V_{BE1}$) can be coupled to a second resistor (R2) using an amplifier (e.g., a transconductance amplifier) that includes an amplifier A1 driving an output transistor 430. The first base-emitter voltage across the second resistor (R2) can generate a CTAT current ($I_{CTAT}$). In the implementation shown, the output transistor 430 is a p-type transistor. For this implementation, the inverting input of the amplifier (A1) is coupled to Q1. The present disclosure is not limited to this configuration. As will be shown, the output transistor may be an n-type transistor, and in this implementation, the non-inverting input of the amplifier is coupled to transistor, Q1.

The second resistor (R2) is coupled to a second current mirror (i.e., CTAT current mirror 420). The CTAT current mirror 420 is in a source degeneration configuration and includes a CTAT current mirror input transistor (MP3) and a first CTAT current mirror output transistor (MP4), each coupled to a corresponding source degeneration resistors (RSD3, RSD4). The CTAT current mirror 420 is configured to receive the CTAT current ($I_{CTAT}$) at a first side (i.e., input side) and to generate a first copy of the CTAT current ($I_{CTAT_M1}$) at a first output side of the CTAT current mirror 420. Based on FIG. 4, the CTAT current may be expressed by the equation below.

$$I_{CTAT} = I_{\mathrm{CTAT_M1}} = \frac{V_{BE1}}{R_2} \tag{18}$$

The CTAT current mirror and the PTAT current mirror can include multiple outputs to generate multiple copies of the CTAT current and PTAT current, respectively. The first output side of the CTAT current mirror 420 (i.e., a first CTAT output) includes transistor MP4 in a source degeneration configuration with source degeneration resistor RSD4 that is configured to generate the first copy of the CTAT current (i.e., $I_{CTAT_M1}$). The PTAT current mirror 410 can further include a second output side (i.e., a PTAT second output 412) that includes transistor MP5 in a source degeneration configuration with source degeneration resistor, RSD5 (e.g., RSD5=RSD1). The PTAT second output 412 is configured to generate a first copy of the PTAT current (i.e., $I_{PTAT_M1}$).

The first copy of the CTAT current ($I_{CTAT_M1}$) and the first copy of the PTAT current ($I_{PTAT_M1}$) can be coupled to a first output circuit (i.e., first output 440) where they are combined (i.e., summed). The first output 440 may include a third resistor (R3) to convert the combined CTAT and PTAT current components into a reference voltage, $V_{REF}$. The reference voltage ($V_{REF}$) can be a voltage (e.g., 1.2 volts (V)) that is substantially stable with temperature. Based on FIG. 4, the reference voltage may be expressed by the equation below.

$$V_{REF} = \frac{R_3}{R_2} V_{BE1} + \frac{R_3}{R_1} \Delta V_{BE} \tag{19}$$

The CTAT current mirror 420 can further include a second output side (i.e., a CTAT second output 422) that includes transistor MP6 in a source degeneration configuration with source degeneration resistor, RSD6. The CTAT second output 422 is configured to generate a second copy of the CTAT current (i.e., $I_{CTAT_M2}$).

The PTAT current mirror 410 can further include a third output side (i.e., a PTAT third output 413) that includes transistor MP7 in a source degeneration configuration with source degeneration resistor, RSD7. The PTAT third output 413 is configured to generate a second copy of the PTAT current (i.e., $I_{PTAT_M2}$).

The second copy of the CTAT current ($I_{CTAT_M2}$) and the second copy of the PTAT current ($I_{PTAT_M2}$) can be coupled to a second output circuit (i.e., second output 450) where they are combined (i.e., summed) to generate a reference current, $I_{REF}$. The reference current ($I_{REF}$) can be a current that is substantially stable with temperature.

A value of the reference voltage ($V_{REF}$) of the bandgap reference circuit 400 can be adjusted by an adjustment of a resistance in the circuit 400. For example, a resistance of the third resistor (R3) may be adjustable, and by adjusting the resistance of the third resistor (R3), the value of the reference voltage ($V_{REF}$) may be adjusted (e.g., higher or lower). For example, a value of the reference voltage ($V_{REF}$) at a particular temperature (e.g., 25° C.) may be increased or decreased by adjusting the third resistor R3. The third resistor (R3) in the circuit provide a means for adjusting the value (i.e., level) of the reference voltage ($V_{REF}$) without affecting a temperature coefficient of the reference voltage. The circuit 400 provides other means to adjust the temperature coefficient of the reference voltage A temperature coefficient (TC) of the reference voltage ($V_{REF}$) of the bandgap reference circuit 400 can be adjusted using one or more variable resistors in the circuit For example, an amount of change that the reference voltage ($V_{REF}$) exhibits over a range of temperatures may be increased or decreased by adjusting the resistors R1 and/or R2.

A temperature coefficient (TC) of the reference current ($I_{REF}$) of the bandgap reference circuit 400 can be adjusted using of one or more variable resistors in the circuit. For example, a resistance of the sixth source degeneration resistor (RSD6) may be adjusted to adjust the CTAT current component ($I_{CTAT_M2}$) used to generate the reference current ($I_{REF}$). Likewise, a resistance of the seventh source degeneration resistor (RSD7) may be adjusted to adjust the PTAT current component ($I_{PTAT_M2}$) used to generate the reference current ($I_{REF}$). By adjusting either (or both) RSD6 and RSD7, the temperature coefficient (TC) of the reference current may be adjusted. For example, an amount of change that the reference current ($I_{REF}$) exhibits over a range of temperatures may be increased or decreased by adjusting the source degeneration resistors RSD6 and RSD7.

Some example adjustments to the resistances have been described for the bandgap reference circuit implementation of FIG. 4. Based on these examples, one skilled in the art may conclude that other possible adjustments, or possible combinations of adjustments, can be used to adjust (i) a value of the reference voltage or reference current at a particular temperature and/or (ii) a rate of change of the reference voltage or reference current over a range of temperatures. Accordingly, the present disclosure is not strictly limited to the example adjustments described. Additionally, the bandgap reference circuit may include more or fewer outputs than shown in this implementation. A PTAT current mirror may include a plurality of PTAT current mirror output transistors, each having a source coupled to a corresponding source degeneration resistor. Likewise, a CTAT current mirror may include a plurality of CTAT current mirror output transistors, each having a source coupled to a corresponding source degeneration resistor.

The bandgap reference circuit implementation of FIG. 4 is configured to reduce random mismatches in the PTAT current mirror 410 and/or the CTAT current mirror 420 through the use of source degeneration. Random mismatches may include variations in device parameters (e.g., device length, channel doping, oxide thickness, etc.) due to random variations in the lithography and/or other processes used for fabricating the devices. Systematic mismatches, however, may still exist. Systematic mismatches may include variations in circuit operation due to the design (e.g., topology) and/or the layout of the circuit.

Figure 5:
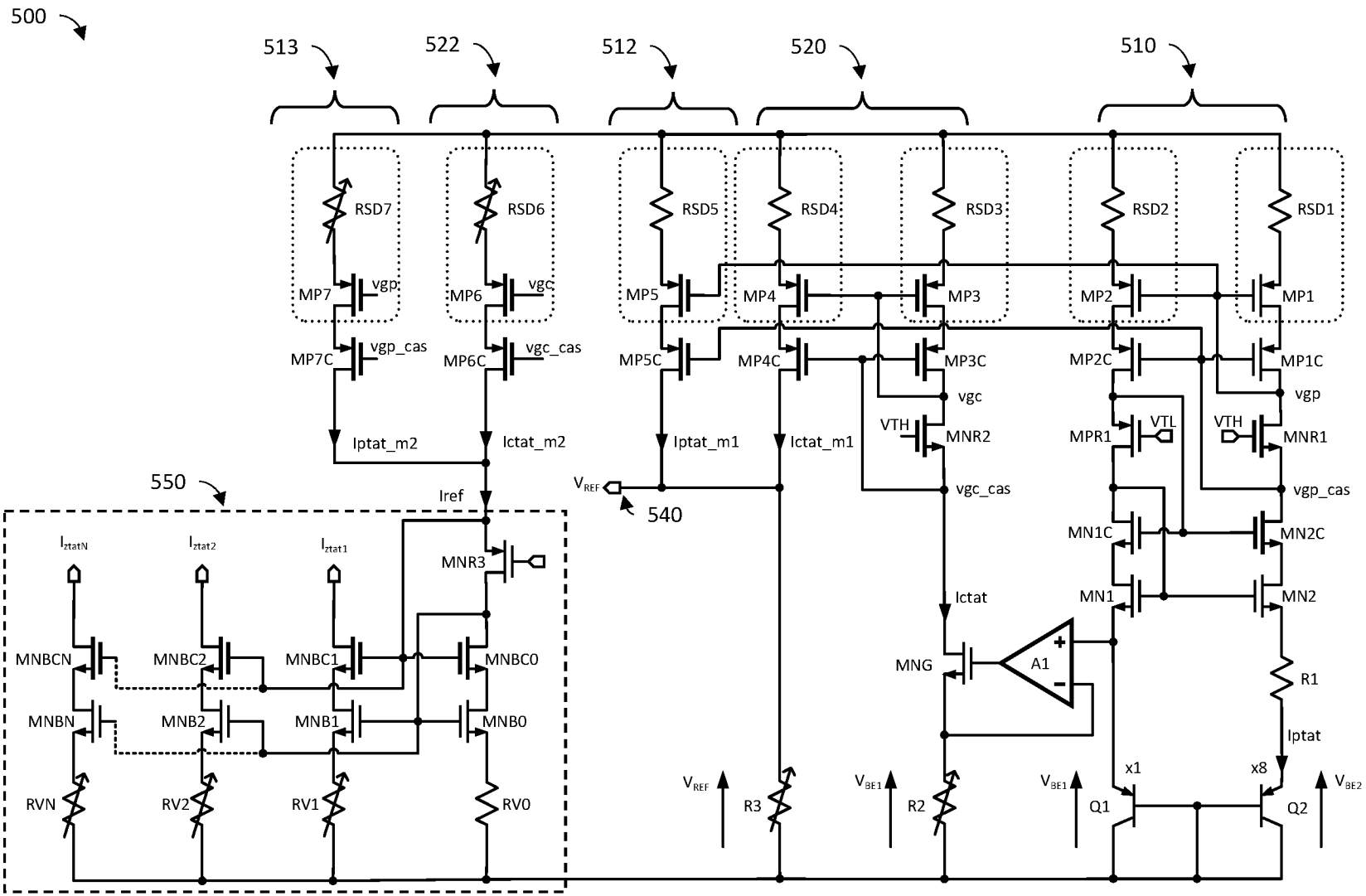
FIG. 5 is a schematic of a bandgap reference circuit according to a second possible implementation of the present disclosure.

FIG. 5 is a schematic of a bandgap reference circuit according to a second possible implementation of the present disclosure. The second possible implementation, uses a similar topology of the first possible implementation to reduce (e.g., eliminate) random mismatches; however, unlike the first possible implementation, the second possible implementation utilizes current mirrors in a cascode configuration to reduce (e.g., eliminate) systematic mismatches. Additionally, the second possible implementation utilizes an output transistor MNG that is n-type. Accordingly, the amplifier A1 has a non-inverting input coupled to Q1.

The bandgap reference circuit 500 includes a PTAT current mirror using source degeneration resistors RSD1 and RSD2 to improve (i.e., make more accurate) the mirroring of the PTAT current by reducing a random mismatch. The PTAT current mirror is in a cascode configuration (i.e., a cascode PTAT current mirror 510) to improve the mirroring of the PTAT current by reducing a systematic mismatch. Additionally, the cascode configuration can boost an output impedance of the PTAT current mirror.

The bandgap reference circuit 500 includes a CTAT current mirror using source degeneration resistors RSD5 and RSD4 to improve (i.e., make more accurate) the mirroring of the CTAT current by reducing a random mismatch. The CTAT current mirror is in a cascode configuration (i.e., a cascode CTAT current mirror 520) to improve the mirroring of the CTAT current by reducing a systematic mismatch. Additionally, the cascode configuration can boost an output impedance of the CTAT current mirror.

Additionally, the bandgap reference circuit 500 includes a PTAT second output 512, a CTAT second output 522, and a PTAT third output 513 configured to function as described for the implementation of FIG. 4 but that are in a cascode configuration.

In a cascode configuration, each transistor in a current mirror of the bandgap reference circuit 500 includes a corresponding cascode transistor. For example, the cascode PTAT current mirror 510 includes an input transistor MP1 and a corresponding cascode transistor MP1C. The cascode PTAT current mirror 510 further includes an output transistor MP2 and a corresponding cascode transistor MP2C. Additionally, the cascode PTAT current mirror 510 includes biasing resistors. The resistors can be implemented as transistors operating in a triode region in order to save die area. For example, the cascode PTAT current mirror 510 can include a first (p-type) transistor MPR1 driven by a tied-low voltage (VTL) to bias the NMOS cascade current mirror (NM1, MN1C, MN2 and MN2C) and a second (n-type) transistor MNR1 driven by a tied-high voltage (VTH) to bias the PMOS cascade current mirror (MP1, MP1C, MP2 and MP2C).

The bandgap reference circuit according to a second possible implementation shown in FIG. 5 further includes a first output circuit (i.e., first output 540) and a second output circuit (i.e., second output 550). The second output 550 includes an output current mirror. The output current mirror is configured to generate a plurality of reference current ($I_{ref}$) copies. Each reference current copy is a zero to absolute temperature (ZTAT) current (i.e., $I_{ZTAT1}$, $I_{ZTAT2}$, . . . $I_{ZTATn}$). The reference current copies can each be trimmed individually by a resistor (RV1, RV2, . . . RVn) to adjust a temperature coefficient for each copy.

The bandgap reference circuit 500 includes a plurality of variable resistors (e.g., R2, R3, RSD4, RSD5, RSD6, and RSD7) that can be adjusted (i.e., trimmed) to change (i) a value of the reference voltage or reference current at a particular temperature and/or (ii) a rate of change of the reference voltage or reference current over a range of temperatures, as described previously.

Figure 6:
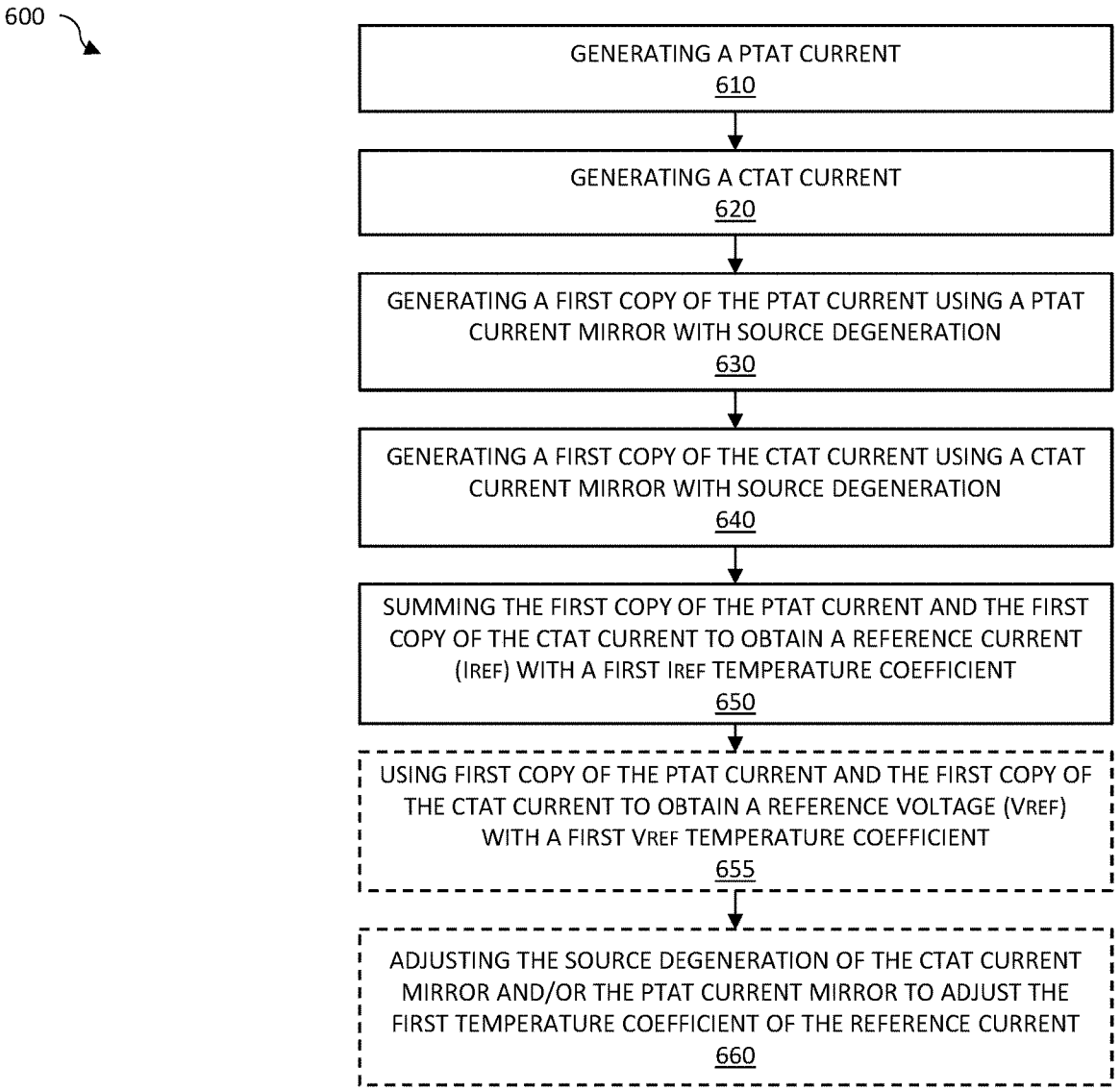
FIG. 6 is a flow chart of a method for generating a reference current and/or reference voltage.

FIG. 6 is a flow chart of a method for generating a reference signal (e.g., reference current, reference voltage). The method 600 includes generating 610 a PTAT current and generating 620 a CTAT current. As mentioned, the PTAT current can be generated based on a difference between base-emitter voltages ($\Delta V_{BE}$) of two diode-connected bipolar junction transistors (BJTs) having different size ratio, while the CTAT current can be generated based on one of the base-emitter voltages of the diode-connected BJT ($V_{BE}$). The method further includes generating 630 a first copy of the PTAT current ($I_{ptat_m1}$) using a PTAT current mirror with source degeneration. The PTAT current mirror may include an input transistor and one or more output transistors. Each transistor is source degenerated by having its source terminal coupled to a source degeneration resistor. The source degeneration can improve the matching of the transistors to provide a better (e.g., more accurate) copy of a current. The method further includes generating 640 a first copy of the CTAT current ($I_{ctat_m1}$) using a CTAT current mirror with source degeneration. The CTAT current mirror may include an input transistor and one or more output transistors. Each transistor is source degenerated by having its source terminal coupled to a source degeneration resistor. The method further includes summing 650 the first copy of the PTAT current ($I_{ptat_m1}$) and the first copy of the CTAT current ($I_{ctat_m1}$) to generate a temperature stable reference current ($I_{REF}$). The reference current may have a first $I_{REF}$ temperature coefficient that varies little (i.e., may be substantially flat) over a range of temperatures due to respective contributions of the first copy of the PTAT current ($I_{ptat_m1}$) and the first copy of the CTAT current ($I_{ctat_m1}$). The method may further include using 655 the first copy of the PTAT current and the first copy of the CTAT current to generate a reference voltage ($V_{REF}$) with a first $V_{REF}$ temperature coefficient. In other words, the method may generate a reference current, a reference voltage, or both a reference current and a reference voltage. Additionally, the method may include generating a plurality of reference currents and/or reference voltages, each having a unique level and/or temperature coefficient.

In a possible implementation of the method, the temperature coefficient of the reference current may be adjusted 660 by adjusting the relative contributions of the first copy of the PTAT current ($I_{ptat_m1}$) and the first copy of the CTAT current ($I_{ctat_m1}$) to the reference current. The relative contributions of the first copy of the PTAT current ($I_{ptat_m1}$) and the first copy of the CTAT current ($I_{ctat_m1}$) may be adjusted by adjusting the source generation of the PTAT current mirror and/or the CTAT current mirror. Adjusting the source generation in the PTAT current mirror may include adjusting one or more source degeneration resistors in the PTAT current mirror. Likewise, adjusting the source generation in the CTAT current mirror may include adjusting one or more source degeneration resistors in the CTAT current mirror.

In another possible implementation of the method, the reference current is converted to a reference voltage. For example, the reference voltage may be generated by a resistor that receives the reference current. In another possible implementation, a value of the reference voltage for a particular temperature may be adjusted by adjusting a resistance of the resistor.

As mentioned, the effects of random mismatches between a pair of transistors may depend on an operating region of the pair of transistors. For example, in a low power application, the pair of transistors may operate in a subthreshold region, in which the effects of random mismatches are pronounced, resulting in a poor matching performance of the pair of transistors. The disclose bandgap reference circuit with source degeneration can improve the matching performance of pairs of transistors operating in subthreshold region. Accordingly, the disclosed bandgap reference circuit may be used in low power applications, including but not limited to, the internet of things, self-power energy harvesting systems, and wearable medical devices.

The disclosed bandgap reference circuit using source degeneration may offer several advantages over other techniques for reducing the effects of random mismatches in a bandgap reference circuit (e.g., using transistors with a large multiplicity). For example, the disclosed approach may provide a reference signal that is substantially independent of temperature even when transistors in the bandgap reference circuit are operated in weak inversion (i.e., even in low power operation). Additionally, the disclosed approach can facilitate fine adjustments of the PTAT current and/or the CTAT current to create a temperature stable output current. Additionally, the disclosed approach can facilitate individual trimming of all mirrored (i.e., copied) currents and individual trimming of voltage/current temperature coefficients. Additionally, the disclosed approach may offer a reduced size because large transistors are not required for matching.

In the specification and/or figures, typical embodiments have been disclosed. The present disclosure is not limited to such exemplary embodiments. The use of the term "and/or" includes any and all combinations of one or more of the associated listed items. The figures are schematic representations and so are not necessarily drawn to scale. Unless otherwise noted, specific terms have been used in a generic and descriptive sense and not for purposes of limitation.

Unless defined otherwise, all technical and scientific terms used herein have the same meaning as commonly understood by one of ordinary skill in the art. Methods and materials similar or equivalent to those described herein can be used in the practice or testing of the present disclosure. As used in the specification, and in the appended claims, the singular forms "a," "an," "the" include plural referents unless the context clearly dictates otherwise. The term "comprising" and variations thereof as used herein is used synonymously with the term "including" and variations thereof and are open, non-limiting terms. The terms "optional" or "optionally" used herein mean that the subsequently described feature, event or circumstance may or may not occur, and that the description includes instances where said feature, event or circumstance occurs and instances where it does not. Ranges may be expressed herein as from "about" one particular value, and/or to "about" another particular value. When such a range is expressed, an aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

Some implementations may be implemented using various semiconductor processing and/or packaging techniques. Some implementations may be implemented using various types of semiconductor processing techniques associated with semiconductor substrates including, but not limited to, for example, Silicon (Si), Gallium Arsenide (GaAs), Gallium Nitride (GaN), Silicon Carbide (SiC) and/or so forth.

While certain features of the described implementations have been illustrated as described herein, many modifications, substitutions, changes and equivalents will now occur to those skilled in the art. It is, therefore, to be understood that the appended claims are intended to cover all such modifications and changes as fall within the scope of the implementations. It should be understood that they have been presented by way of example only, not limitation, and various changes in form and details may be made. Any portion of the apparatus and/or methods described herein may be combined in any combination, except mutually exclusive combinations. The implementations described herein can include various combinations and/or sub-combinations of the functions, components and/or features of the different implementations described.

The invention claimed is:

1. A method for generating a reference current, the method comprising:

generating a proportional-to-absolute-temperature (PTAT) current;

generating a complementary-to-absolute-temperature (CTAT) current;

generating a first copy of the PTAT current using a PTAT current mirror with source degeneration adjustable by an adjustable resistance;

generating a first copy of the CTAT current using a CTAT current mirror with source degeneration adjustable by an adjustable resistance; and combining the first copy of the PTAT current and the first copy of the CTAT current to generate a first reference current with a first temperature coefficient.

2. The method for generating a reference current according to claim 1, further comprising:

adjusting the source degeneration of one or both of the CTAT current mirror and the PTAT current mirror to obtain a second reference current with a second temperature coefficient.

3. The method for generating a reference current according to claim 2, wherein:

the PTAT current mirror includes a first input transistor coupled at a source terminal to a first source degeneration resistor and a first output transistor coupled at a source terminal to a second source degeneration resistor;

the CTAT current mirror includes a second input transistor coupled at a source terminal to a third source degeneration resistor and a second output transistor coupled at a source terminal to a fourth source degeneration resistor; and the adjusting the source degeneration of one or both of the CTAT current mirror and the PTAT current mirror includes adjusting a resistance of any of the first source degeneration resistor, the second source degeneration resistor, the third source degeneration resistor, or the fourth source degeneration resistor.

4. The method for generating a reference current according to claim 1, further comprising:

inputting the first reference current to a first output resistor to obtain a first reference voltage.

5. The method for generating a reference current according to claim 4, further comprising:

adjusting a resistance of the first output resistor to change the first reference voltage.

6. The method for generating a reference current according to claim 1, wherein the PTAT current mirror is in a cascode configuration, and the CTAT current mirror is in a cascode configuration.

7. The method for generating a reference current according to claim 1, further comprising:

coupling the reference current to an output current mirror with source degeneration, the output current mirror with source degeneration including a plurality of output transistors, each output transistor coupled at a source terminal to a source degeneration resistor; and adjusting a particular source degeneration resistor to adjust a temperature coefficient of a current conducted by a particular output transistor coupled to the particular source degeneration resistor.

8. A bandgap reference circuit, comprising:

a current generator configured to generate a proportional-to-absolute-temperature (PTAT) current and a complementary-to-absolute-temperature (CTAT) current;

a PTAT current mirror with source degeneration coupled to the current generator and configured to generate at least one copy of the PTAT current, the source degeneration of the PTAT current mirror being adjustable to adjust a level of each of the at least one copy of the PTAT current;

a CTAT current mirror with source degeneration coupled to the current generator and configured to generate at least one copy of the CTAT current, the source degeneration of the CTAT current mirror being adjustable to adjust a level of each of the at least one copy of the CTAT current; and at least one output configured to combine one of the at least one copy of the PTAT current with one of the at least one copy of the CTAT current to generate a reference current.

9. The bandgap reference circuit according to claim 8, wherein the current generator includes:

a first diode-connected transistor and a second diode-connected transistor that are biased to produce a voltage difference across a first resistor that is proportional to absolute temperature, the voltage difference across the first resistor generating the PTAT current; and an amplifier configured to couple a voltage of the first diode-connected transistor, which is complementary to absolute temperature, to a second resistor to generate the CTAT current.

10. The bandgap reference circuit according to claim 8, wherein:

the PTAT current mirror with source degeneration includes:

a PTAT current mirror input transistor having a source terminal coupled to a corresponding source degeneration resistor, and at least one PTAT current mirror output transistors, each of the at least one PTAT current mirror output transistors having a source terminal coupled to a corresponding source degeneration resistor; and the CTAT current mirror with source degeneration includes:

a CTAT current mirror input transistor having a source terminal coupled to a corresponding source degeneration resistor, and at least one CTAT current mirror output transistors, each of the at least one CTAT current mirror output transistors having a source terminal coupled to a corresponding source degeneration resistor.

11. The bandgap reference circuit according to claim 10, wherein the PTAT current mirror input transistor, the at least one PTAT current mirror output transistors, the CTAT current mirror input transistor, and the at least one CTAT current mirror output transistors are P-type metal oxide semiconductor (MOS) transistors.

12. The bandgap reference circuit according to claim 10, wherein the PTAT current mirror input transistor, the at least one PTAT current mirror output transistors, the CTAT current mirror input transistor, and the at least one CTAT current mirror output transistors are operated in a weak inversion condition.

13. The bandgap reference circuit according to claim 10, wherein:

the source degeneration resistors corresponding to the at least one PTAT current mirror output transistors are adjustable; and the source degeneration resistors corresponding to the at least one CTAT current mirror output transistors are adjustable.

14. The bandgap reference circuit according to claim 13, wherein:

an adjustment to the source degeneration resistors controls a level of the reference current.

15. The bandgap reference circuit according to claim 13, wherein:

an adjustment to the source degeneration resistors controls a temperature coefficient of the reference current.

16. The bandgap reference circuit according to claim 8, wherein the at least one output includes an output resistor to generate a reference voltage.

17. The bandgap reference circuit according to claim 16, wherein the output resistor can be adjusted to change a level of the reference voltage.

18. A bandgap reference circuit, comprising:

a current generator configured to generate a proportional-to-absolute-temperature (PTAT) current and a complementary-to-absolute-temperature (CTAT) current;

a PTAT current mirror with source degeneration coupled to the current generator and configured to generate at least one copy of the PTAT current, the PTAT current mirror in a cascode configuration;

a CTAT current mirror with source degeneration coupled to the current generator and configured to generate at least one copy of the CTAT current the CTAT current mirror in the cascode configuration; and at least one output configured to combine one of the at least one copy of the PTAT current with one of the at least one copy of the CTAT current to generate a reference current.

19. The bandgap reference circuit according to claim 18, wherein the at least one output includes an output current mirror configured to generate one or more copies of the reference current.

* * * * *